US006571948B2

(12) United States Patent
Jones

(10) Patent No.: US 6,571,948 B2
(45) Date of Patent: Jun. 3, 2003

(54) KEYBOARD LOCK BOX

(75) Inventor: Gregory Jones, Atlanta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 09/894,338

(22) Filed: Jun. 28, 2001

(65) Prior Publication Data

US 2003/0000857 A1 Jan. 2, 2003

(51) Int. Cl.[7] ..... B65D 85/00
(52) U.S. Cl. ..... 206/320; 206/1.5; 220/841
(58) Field of Search ..... 206/320, 1.5, 576, 206/580, 372, 373; 220/810, 836, 841, 843, 826

(56) References Cited

U.S. PATENT DOCUMENTS 2,117,151 A * 5/1938 Cowan ..... 220/378
4,854,475 A * 8/1989 Riihimaki et al. ..... 206/369
4,896,070 A * 1/1990 Reid et al. ..... 220/826
5,074,413 A * 12/1991 Ikuta et al. ..... 190/115
D323,929 S * 2/1992 Hodson ..... D14/440
5,154,456 A * 10/1992 Moore et al. ..... 292/162
5,214,574 A * 5/1993 Chang ..... 190/102
5,215,726 A * 6/1993 Kudla et al. ..... 206/370
5,632,373 A * 5/1997 Kumar et al. ..... 206/305
5,682,993 A * 11/1997 Song ..... 206/320
5,762,250 A * 6/1998 Carlton et al. ..... 108/43
5,808,865 A * 9/1998 Alves ..... 361/685
5,835,344 A * 11/1998 Alexander ..... 206/320
6,000,252 A * 12/1999 Murray et al. ..... 70/58
6,006,557 A * 12/1999 Carl et al. ..... 70/58
6,042,075 A * 3/2000 Burch, Jr. ..... 248/442.2
6,145,661 A * 11/2000 Jung ..... 190/102
6,164,442 A * 12/2000 Stravitz ..... 206/233
6,257,407 B1 * 7/2001 Truwit et al. ..... 206/305
6,269,948 B1 * 8/2001 Jackson ..... 108/43

* cited by examiner

*Primary Examiner*—Shian Luong
(74) *Attorney, Agent, or Firm*—Merchant & Gould, LLC

(57) ABSTRACT

A keyboard lock box for securing a computer keyboard from unauthorized access and use is provided. The lock box includes a box-shaped apparatus in which a keyboard may be stored and secured from unauthorized access and use. The keyboard lock box includes a base in which the keyboard may be placed. A lid is provided for closing the keyboard lock box, and a lock and latch combination is integrated with the lid and base for locking the lid to the base. An alternate embodiment of the lock box includes a removable lid that may be removed leaving the keyboard at rest on a keyboard tray. The lock box may be implemented for storage only, or it may be implemented as a storage apparatus and holding apparatus during use of the computer keyboard.

11 Claims, 4 Drawing Sheets

KEYBOARD LOCK BOX

TECHNICAL FIELD

The present invention generally relates to appliances for computer equipment, and more particularly, the present invention relates to a lock box for storing and securing a computer keyboard.

BACKGROUND OF THE INVENTION

In recent years the number of computers in use for business, home, education and entertainment has increased dramatically. Often a business or educational institution may have hundreds or thousands of computers in use by employees, students and patrons. In a typical setting, a computer user either works on a computer that is a stand-alone device or that is networked to other computers. When a computer user needs to leave her computer to take a break, have a meal or go home, the user often desires to leave the computer on and running for a number of reasons. For example, the user may be engaged in file backup or other time consuming processes, and the user would like her computer to run while she is away. At home, the user may wish to leave the computer running for similar reasons while the user steps away or runs an errand. The user may desire to leave an electronic mail application running so that she can access the application from a remote location. Or, the user may simply desire to be away from the computer for a short time without shutting down the computer, or otherwise securing the computer from undesired tampering. In addition, many computer users now use cordless keyboards which when left unsecured may be easily removed form the users' work area.

Unfortunately, leaving the computer on and unsecured often invites unwanted and unauthorized access to the computer. If the computer is on and unsecured, an unauthorized person may obtain access to the user's files and data. The computer may be secured by shutting down the computer, but that remedy denies the user the desired access described above.

Methods are available for "locking down" the keyboard of a computer where only the user with a password may gain entry. However, such a security remedy denies access to the computer by administrative personnel who may need to perform hardware or software and maintenance or upgrades while the user is away.

Accordingly, there is a need in the art for an apparatus for securing a computer keyboard from unauthorized access, use and removal. It is with respect to these considerations and others that the present invention has been made.

SUMMARY OF THE INVENTION

The above and other problems are solved by a keyboard lock box for securing a computer keyboard from unauthorized access, use and removal. Generally described, the keyboard lock box of the present invention includes a box shaped apparatus in which a keyboard may be stored and secured from unauthorized access, use and removal. The keyboard lock box includes a base in which the keyboard may be placed. A lid is provided for closing the keyboard lock box, and a lock and latch combination is integrated with the lid and base for locking the lid to the base. The lock box may be implemented for storage only, or it may be implemented as a storage apparatus and holding apparatus during use of the computer keyboard.

According to another aspect of the invention, the lock box includes a tray for supporting a computer keyboard and a box shaped lid container for enclosing the keyboard when the lid container is placed over and upon the tray. A pair of flanges on the back panel of the lid container engage a pair of flange receivers on a rear edge of the tray that allow the lid container to be attached to the tray, but also allow the lid container to be detached for use of the keyboard on the tray without the lid container. The tray may include an extended portion that extends forward of the front panel of the lid container for use as a wrist rest.

These and other features and advantages, which characterize the present invention, will be apparent from a reading of the following detailed description and a view of the associated drawings. It is to be understood that both the foregoing description and the following detailed description are exemplary and explanatory only and are not restrictive of the invention, as claimed.

DETAILED DESCRIPTION OF THE INVENTION

Figure 1:
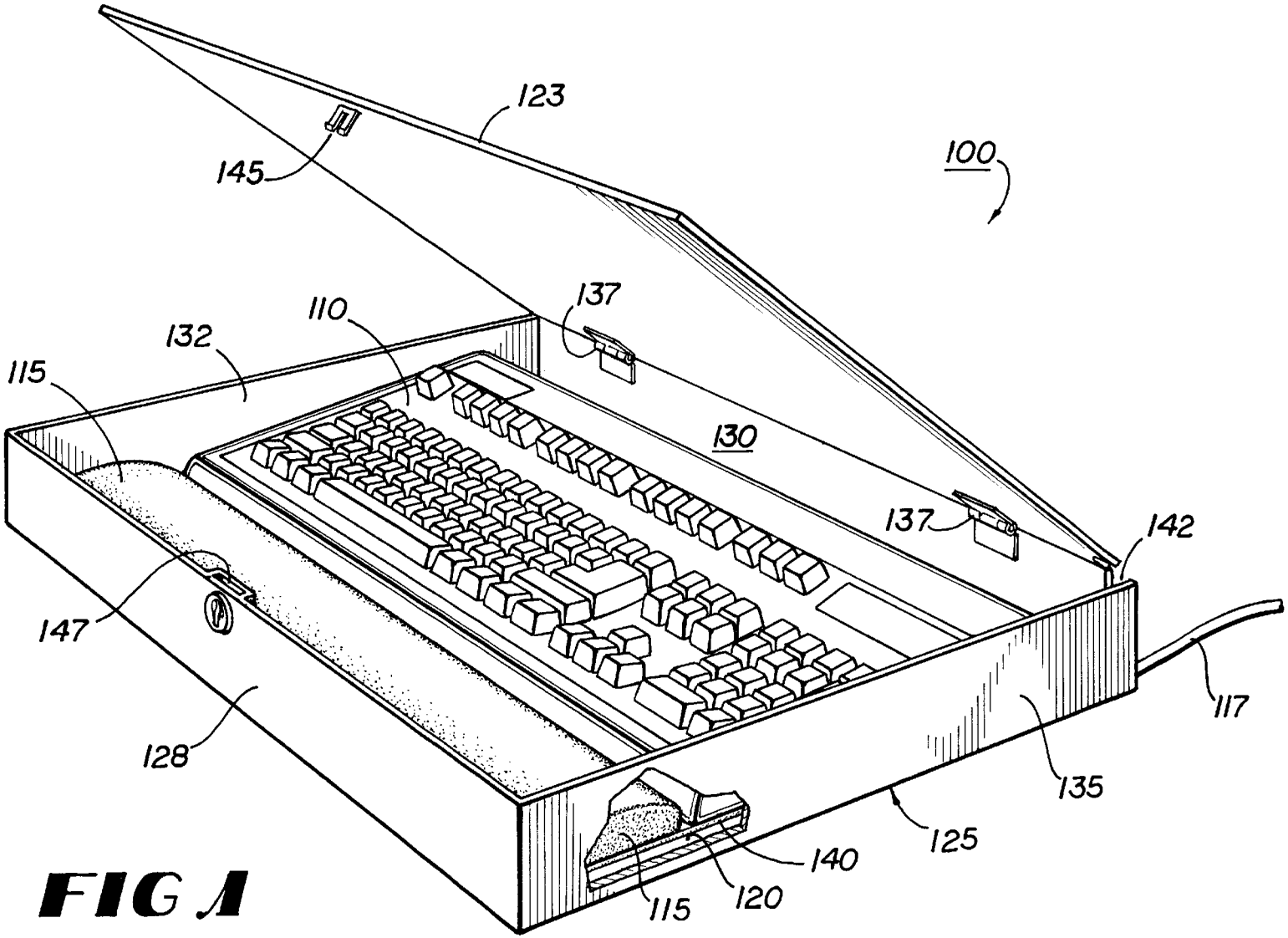
FIG. 1 is a pictorial view of a keyboard lock box according to an exemplary embodiment of the present invention showing an opened lock box containing a computer keyboard.

In an exemplary embodiment of the present invention, a lock box is provided for securing a computer keyboard from unauthorized access and use. The present invention may be understood more readily by reference to the following detailed description of the invention and the drawings. Referring now to the drawings, like numeral refer to like parts throughout the several views.

Figure 2:
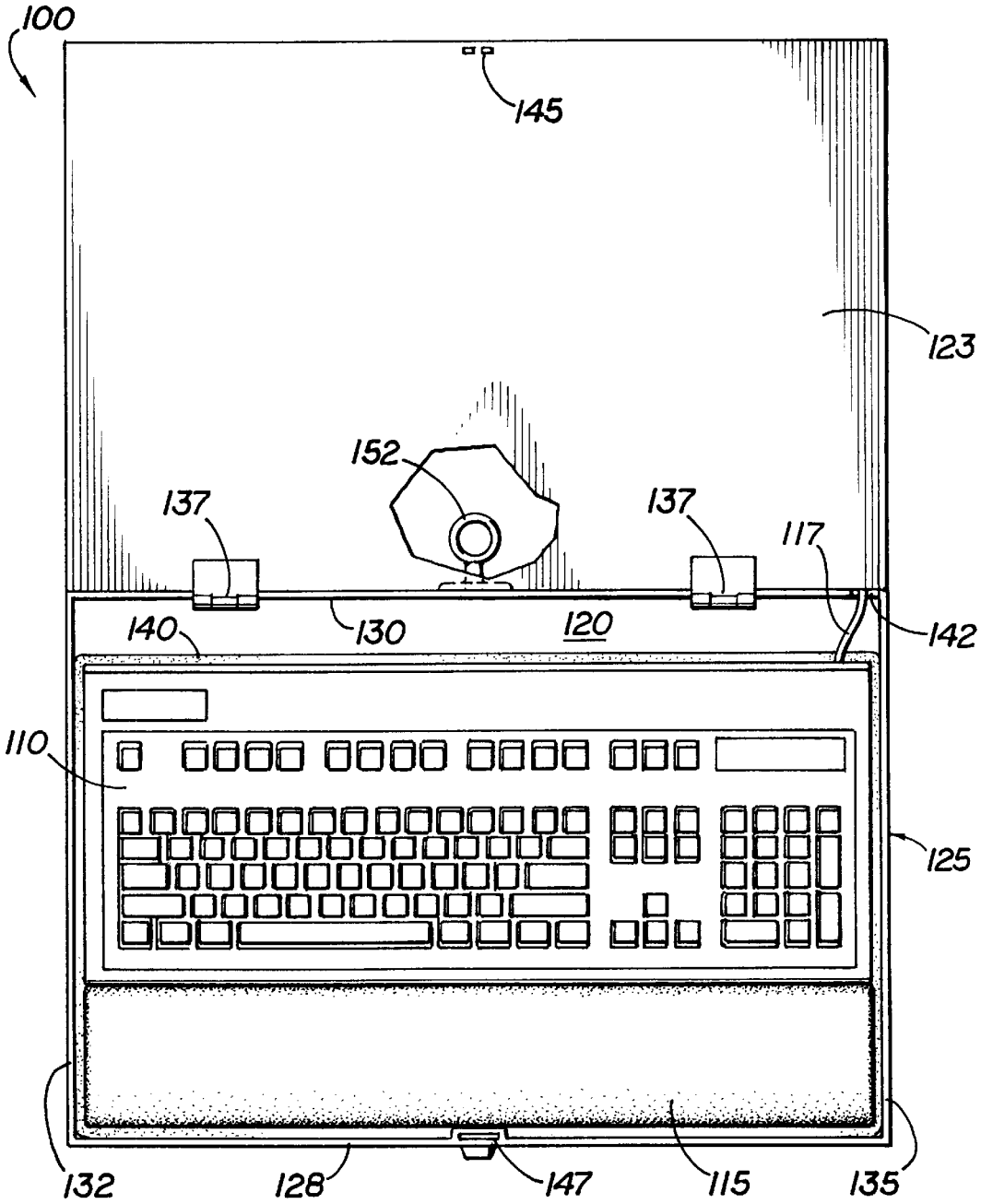
FIG. 2 is a top plan view of the keyboard lock box, illustrated in FIG. 1, showing the keyboard lock box in an open configuration containing a computer keyboard.

FIG. 1 is a pictorial view of a keyboard lock box according to an exemplary embodiment of the present invention showing an opened lock box containing a computer keyboard. As shown in FIG. 1, the keyboard lock box 100 includes a base 125 and a lid 123 for holding and securing a computer keyboard 110. The lid 123 of the lock box 100 is attached to the base 125 by a pair of hinges 137 that attach the lid 123 to the back panel 130 of the lock box 100. The base 125 of the lock box 100 is a box shaped apparatus having a bottom panel 120 on which rests the keyboard 110, a back panel 130, side panels 132 and 135, and a front panel 128. As shown in FIGS. 1 and 2, optional padding 140 may be disposed on the upper surface of the bottom panel 120 to provide a cushioning for the keyboard 110. A cord access opening or slot 142 is defined in the back panel 130 through which a keyboard cord 117 may be inserted for access to a keyboard stored inside the lock box 100. The cord access opening or slot 142 may extend from an upper edge of back panel 130 downward a distance toward a junction between back panel 130 and bottom panel 120 as shown in FIG. 1.

A lock latch receiver 147 is defined in the front panel 128 of the base 125 for receiving a latch 145 defined in the lid 123. According to the preferred embodiment, the lock latch 145 is received by the latch receiver 147 defined in the front panel 128 of the base 125. Preferably, the latch and receiver combination includes a locking mechanism with which the user may lock the lid 123 to the base 125 to secure the keyboard 110. Referring to FIG. 2, an integral security bracket 152 is illustrated through a cut-away view through the lid 123. The security bracket 152 is defined along the back panel 130 for connection of a security cord or chain for securing the keyboard lock box to prevent removal of the keyboard lock box from the user's work area.

The lock box 100 may be constructed according to a number of dimensions for accommodating different sizes of computer keyboards. According to one embodiment, the keyboard lock box may be approximately 18.5 inches wide by 9.5 inches long by 1.5 inches high. However, the dimensions of the keyboard lockbox may be varied according to size requirements for different types of keyboards and related equipment. For example, referring to FIGS. 1 and 2, the keyboard lock box 100 is illustrated with an optional wrist rest 115 positioned along the front edge of the keyboard 110. In order to accommodate the optional wrist rest 115, the dimensions of the lock box 100 may be modified. Likewise, the keyboard lock box may be made larger to accommodate other computer equipment such as a computer mouse and extra cords. On the other hand, if it is desired that the keyboard lock box be as small as possible to preserve work area space, the keyboard lock box may be constructed with dimensions sufficient only to contain a standard computer keyboard 110.

The lock box 100 may be constructed from a variety of materials including lightweight and durable plastics, metals, such an aluminum, or the lock box may be made from a variety of exotic and beautiful woods and synthetic wood materials. The lock box may be colored from a variety of colors to suit the decor of the user's office, home, school, and the like.

To utilize the keyboard lock box 100, the user of the keyboard 110 places the keyboard 110 inside the lock box positioned on the surface of the optional padding 140, and the user inserts the cord 117 of the keyboard 110 through the cord access opening 142, as illustrated in FIG. 1. It should be understood that for cordless keyboards, the cord access opening is not used. If desired, user may place the optional wrist rest 115 along the front edge of the keyboard 110, as illustrated in FIGS. 1 and 2. To secure the keyboard 110 from an authorized access or use, the lid 123 is then closed about the base 125 and the latch 145 is inserted in the latch receiver 147 and locked.

Figure 3:
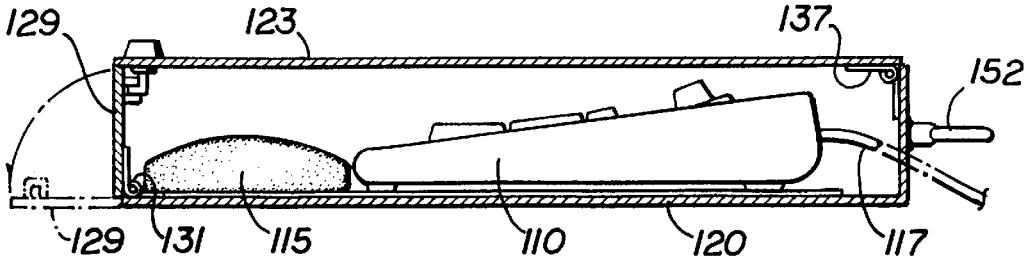
FIG. 3 is a side elevation view of an alternate embodiment of the keyboard lock box illustrated in FIGS. 1 and 2.

FIG. 3 is a side elevation view of an alternate embodiment of the keyboard lock box illustrated in FIGS. 1 and 2. As shown in FIG. 3, a front panel 129 is hingedly attached to the base panel 120 with a pair of hinges 131. During use of the keyboard 110, the user may pivot the front panel 129 down and away from the pair of side panels about an axis formed by the intersection of a lower edge of the front panel 129 and a front edge of the bottom panel 120, such that the front panel 129 is coplanar with the bottom panel for allowing easier access of the user's hands and wrists to the keyboard 110.

Figure 4:
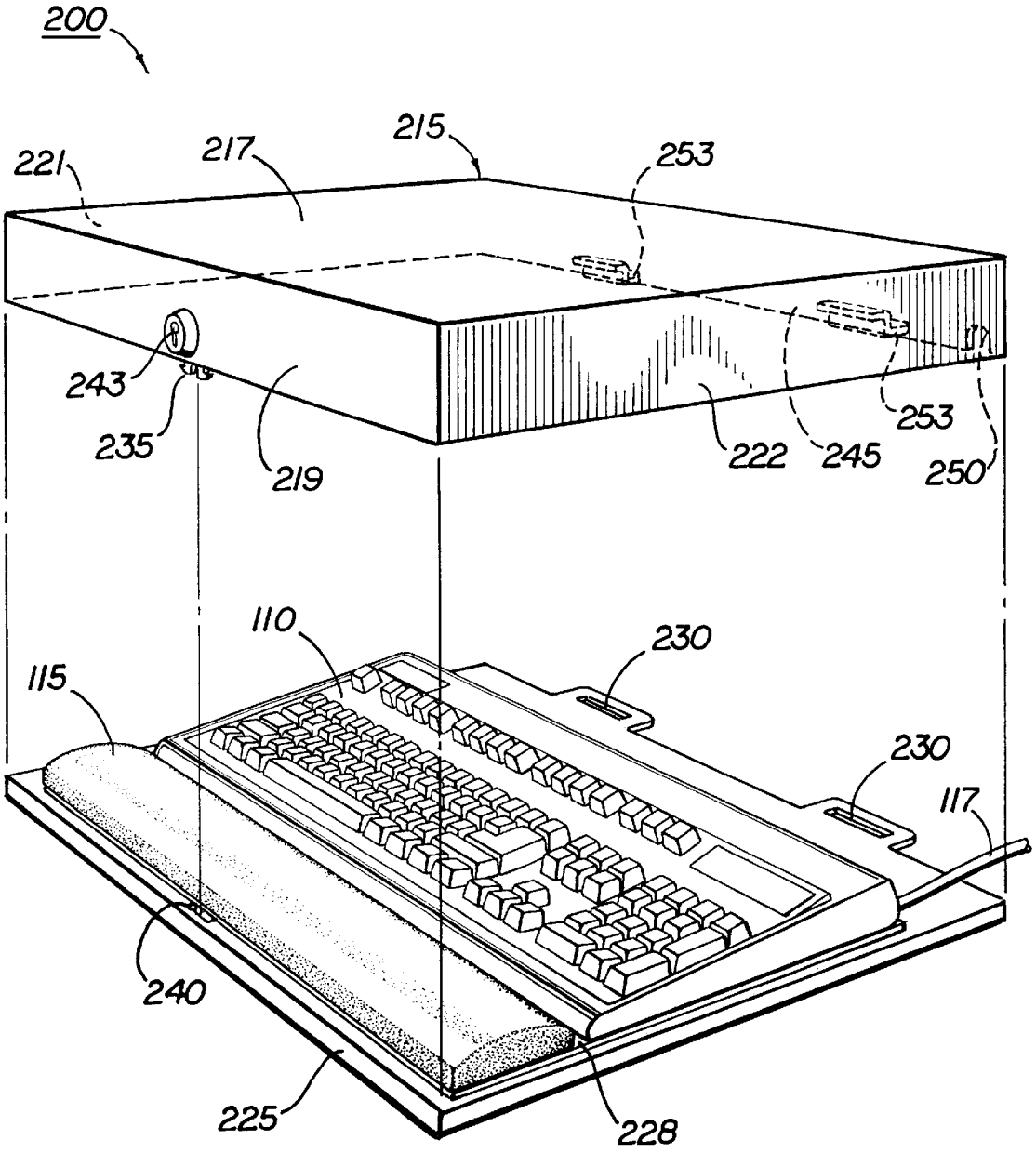
FIG. 4 is a pictorial view of an alternate embodiment of the keyboard lock box of the present invention showing a removable lock box lid and showing a computer keyboard resting on the base of the keyboard lock box.

FIG. 4 is a pictorial view of an alternate embodiment of the keyboard lock box of the present invention showing a removable lock box lid and showing a computer keyboard resting on the base of the keyboard lock box. The alternate embodiment illustrated in FIG. 4 includes a keyboard lock box 200 having a lid container 215 and a tray 225 for securing a keyboard 110 while the keyboard 110 remains at rest on the tray 225. The lid 215 of the lock box 200 is removable from the tray 225 to allow easy access and use of the keyboard 110.

Figure 5:
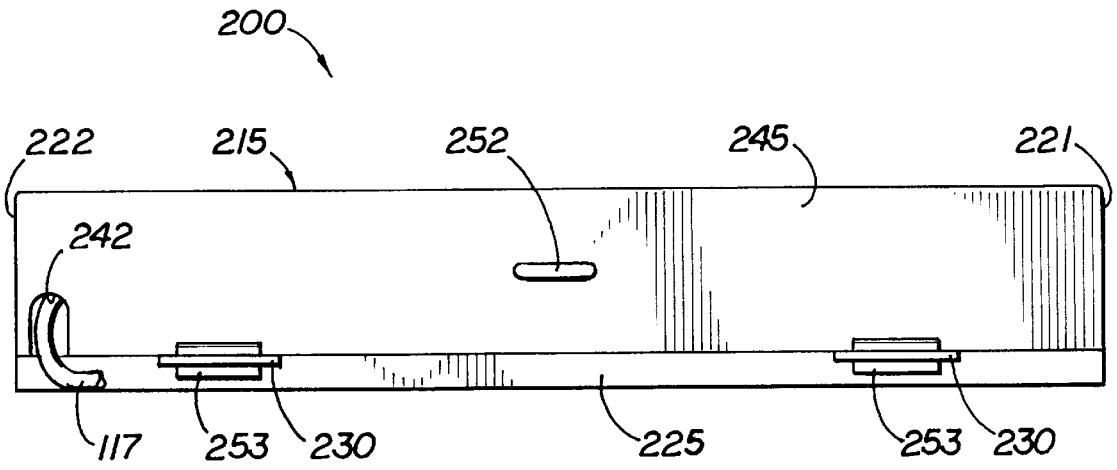
FIG. 5 is a back view of the keyboard lock box illustrated in FIG. 4.

The lid container 215 includes a top panel 217, a front panel 219, side panels 221 and 222 (illustrated in FIG. 5) and a back panel 245 (illustrated in FIG. 5). The lid 215 includes a lock latch 235 with a latch key receiver 243. Referring to FIG. 5, the lid 215 includes a pair of lid flanges 253 for securing the lid 215 to the tray 225. The back panel 245 of the lid 215 includes a cord access opening or slot 242 through which a cord 117 of the keyboard 110 may be inserted. A cord access opening or slot 242 (illustrated in FIG. 5) is defined in the back panel 245 through which a keyboard cord 117 may be inserted for access to a keyboard stored inside the lock box 200. The cord access opening or slot 242 may extend from a lower edge of back panel 245 upward a distance toward a junction between back panel 245 and top panel 217 as shown in FIG. 5.

The tray 225 of the keyboard lock box 200 includes a latch receiver 240 defined along the front edge of the tray 225 for receiving the latch 235 of the lid 215. A pair of lid flange receivers 230 is defined along the rear edge of the tray 225 for receiving the lid flanges 253 of the lid 215. If desired, the tray 225 may have optional padding 228 disposed along the upper surface of the tray 225 to provide cushioning for the keyboard 110.

As with the embodiment of the keyboard lock box described with reference to FIGS. 1 and 2, the keyboard lock box 200, illustrated in FIGS. 4 and 5, may be constructed with a variety of materials and colors. The lock box 200 also may be constructed in a variety of dimensions to accommodate various sizes of computer keyboards and ancillary equipment, such as wrist rests 115.

Use of the keyboard lock box 200 illustrated in FIGS. 4 and 5 allows for easy access and use of the keyboard 110 without removing the keyboard 110 from the keyboard lock box 200. That is, when the user desires to use the keyboard 110, the user unlocks and unlatches the lid 215 from the tray 225 by disengaging the latch 235 from the latch receiver 240. The user may then pivot the front edge of the lid 215 up and away from the tray 225 about an axis formed by the intersection of a lower edge of the back panel 245 and a rear edge of the tray 225 until the pair of spaced-apart flanges 253 are disengaged from the pair of spaced-apart flange receivers 230. After the lid 215 is removed from the tray as described, the user may utilize the keyboard 110 as it rests on the tray 225, as illustrated in FIG. 4. Later, when the user desires to secure the keyboard 110 from unauthorized user access, the user reverses the aforementioned process and replaces the lid 215 to the tray 225 to secure the keyboard 110. Accordingly, the user may utilize the keyboard 110 without completely removing the keyboard 110 from the keyboard lock box 200, illustrated in FIGS. 4 and 5.

Figure 6:
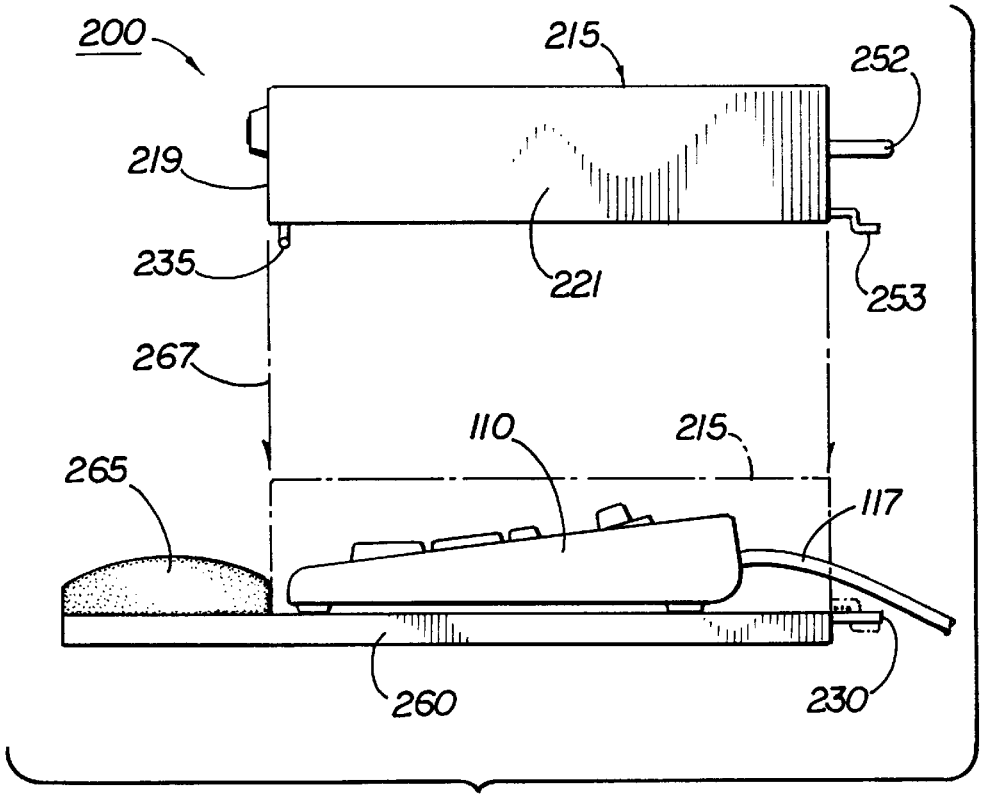
FIG. 6 is side elevation view an alternate embodiment of the keyboard lock box illustrated in FIGS. 4 and 5 showing a removable lid, and showing an extended wrist rest integrated with the base of the keyboard lock box.

FIG. 6 illustrates the side elevation view of an alternate embodiment of the keyboard lock box 200, illustrated in FIGS. 4 and 5. As shown in FIG. 6, alternate tray 260 is provided and has a length that extends past the front panel 219 of the keyboard lock box 200. Disposed along the front edge of the tray 260 forward of the front panel 219 of the lid 215 is a wrist rest 265. According to a preferred embodiment, the wrist rest 265 includes a padded material disposed along the front edge of the extended tray 260 for placement of the user's wrists during operation of the keyboard 110. According to an alternate embodiment, the extended portion of the tray may be detached from the tray 260 about the dotted line 267 illustrated in FIG. 6. When the user desires use and access of the keyboard 110, the user may remove the lid 215, as described above, and the user may utilize the wrist rest 265 during use of the keyboard 110 to provide support and comfort for the user during use of the keyboard 110.

It will be apparent to those skilled in the art that various modifications or variations can be made to the present invention without departing from the scope or spirit of the invention. Other embodiments of the invention will be apparent to those skilled in the art from consideration of the specification and practice of the invention disclosed herein. It is intended that the specification be considered as exemplary only, with a true scope and spirit of the invention being indicated by the following claims.

I claim:

1. A keyboard lock box, comprising:

a substantially planar tray for supporting a keyboard;

a generally rectangular box-shaped lid container having a top panel, a front panel, a back panel and a pair of side panels;

the back panel of the lid container having an opening for inserting a cord into the lid container;

the back panel having a pair of spaced-apart flanges disposed along a lower edge of the back panel for engaging a pair of spaced-apart flange receivers disposed along a rear edge of the tray;

a front portion of the tray having a latch receiver for receiving a latch disposed along a lower portion of the front panel of the lid container;

wherein the lid container forms a compartment for enclosing a keyboard when the lid container is restably positioned upon the tray, wherein the lid container is secured to the tray when the flanges of the lid container are received by the flange receivers of the tray and when the latch of the lid container is received by the latch receiver of the tray; and wherein the lid container is detachably removable from the tray for allowing use of the keyboard while the keyboard remains at rest on the tray, wherein the lid container is removed from the tray by disengaging the latch from the latch receiver and by pivoting the lid container up and away from the tray about an axis formed by the intersection of a lower edge of the back panel and a rear edge of the tray until the pair of spaced-apart flanges are disengaged from the pair of spaced-apart flange receivers.

2. The lock box of claim 1, wherein the tray further comprises:

a layer of padding material disposed on an upper surface of the tray, the layer of padding material forming a cushioning surface for a keyboard.

3. The lock box of claim 1, wherein the tray further comprises:

a security bracket disposed along the back panel, the security bracket for attaching a security cord for securing the lock box from being removed from a location.

4. The lock box of claim 1, wherein the opening of the back panel is a slot extending from a lower edge of the back panel upward a distance toward a junction between the back panel and the top panel.

5. The keyboard lock box of claim 1, further comprising:

an extended section of the tray integral with the tray and extending forward of the front panel of the lid container when the lid container is at rest upon the tray in a latched configuration, the extended portion having an integrated wrist rest along a front edge of the extended section.

6. The keyboard lock box of claim 5, wherein the wrist rest includes a raised portion for supporting the wrists and hands of a user.

7. The keyboard lock box of claim 6, wherein the raised portion of the wrist rest comprises a padded material for enhancing user comfort.

8. The lock box of claim 1, wherein the lock box is formed from wood or synthetic wood material.

9. The keyboard lock box of claim 1, wherein the keyboard lock box further comprises:

a layer of padding material disposed on an upper surface of the substantially planar tray, wherein the layer of padding material forms a cushioning surface on the substantially planar tray; and a security bracket disposed along the back panel, wherein the security bracket is capable of engaging with a security cord to secure the lock box to a location; and wherein the substantially planar tray optionally extends forward of the front panel of the lid container when the lid container is at rest upon the tray in a latched configuration to form an extended portion of the substantially planar tray, the extended portion optionally comprising a wrist rest on an upper surface of the extended portion.

10. A keyboard lock box comprising:

(i) a substantially planar tray for supporting a keyboard;

(ii) a generally rectangular box-shaped lid container having a top panel, a front panel, a back panel and a pair of side panels;

(iii) an opening in the back panel of the lid container for inserting a cord into the lid container;

(iv) a pair of spaced-apart flanges disposed along a lower edge of the back panel for engaging a pair of spaced-apart flange receivers disposed along a rear edge of the tray;

(v) a latch receiver located within the substantially planar tray for receiving a latch disposed along a lower portion of the front panel of the lid container;

wherein the lid container forms a compartment for enclosing a keyboard when the lid container is positioned upon the tray, wherein the lid container is secured to the tray when the flanges of the lid container are received by the flange receivers of the tray and when the latch of the lid container is received by the latch receiver of the tray;

wherein the lid container is detachably removable from the tray for allowing use of the keyboard while the keyboard remains at rest on the tray, wherein the lid container is removed from the tray by disengaging the latch from the latch receiver and by pivoting the lid container up and away from the tray about an axis formed by the intersection of a lower edge of the back panel and a rear edge of the tray until the pair of spaced-apart flanges are disengaged from the pair of spaced-apart flange receivers; and wherein the substantially planar tray comprises an extended section which extends forward of the front panel of the lid container when the lid container is at rest upon the tray in a latched configuration.

11. The lock box of claim 10, wherein the lock box is formed from wood or synthetic wood material.

* * * * *